US006237543B1

(12) United States Patent
Charoton et al.

(10) Patent No.: US 6,237,543 B1
(45) Date of Patent: May 29, 2001

(54) SEALING-STEAM FEED

(75) Inventors: Geral Charoton, Oberehrendingen; Jean-Pierre Rickli, Uster; Ernst Walz, Villigen; Peter Zeller, Langenthal, all of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/552,566

(22) Filed: Apr. 19, 2000

(30) Foreign Application Priority Data

Apr. 29, 1999 (DE) ..... 199 19 653

(51) Int. Cl.[7] ..... F22D 1/32

(52) U.S. Cl. ..... 122/7 R; 122/414; 122/460; 122/466; 122/60; 122/653

(58) Field of Search ..... 122/1 C, 7 R, 122/414, 438, 441, 442, 460, 466, 467, 451.1, 484; 60/653

(56) References Cited

U.S. PATENT DOCUMENTS 3,789,804 * 2/1974 Aguet ..... 122/7 R
4,241,701 * 12/1980 Morse ..... 122/460
6,003,317 * 12/1999 Neubert ..... 60/653

FOREIGN PATENT DOCUMENTS 1 105 431 4/1961 (DE) .
28 41 631 6/1986 (DE) .
43 13 805 11/1994 (DE) .
0 605 156 7/1994 (EP) .

* cited by examiner

*Primary Examiner*—Gregory Wilson
(74) *Attorney, Agent, or Firm*—Burns, Doane, Swecker & Mathis, L.L.P.

(57) ABSTRACT

In some operating states, supplemental additional sealing steam must be fed to the sealing-steam system of a steam turbine. The feeding of supplemental sealing steam from the live-steam line involves considerable problems. According to the invention, therefore, the sealing-steam system is connected via a feeder line to a bleed point of the superheater of the boiler, so that the temperature of the supplemental sealing steam is well below the live-steam data and, in particular, is compatible with the material temperature in the region of the high-pressure shaft seal.

7 Claims, 1 Drawing Sheet

SEALING-STEAM FEED

FIELD OF THE INVENTION

The present invention relates to, a system for feeding sealing steam into shaft seals of a steam turbine, therefor a period.

BACKGROUND OF THE INVENTION

At the points of steam-turbine casings where the shaft of the machine passes through the casing, devices which prevent the ingress of air into the low-pressure turbine stages and also prevent the escape of steam into the atmosphere from casing sections of higher pressure must be provided. In this case, the only suitable seals are essentially non-contact seals, which of course exhibit residual leakage quantities.

Systems in which a barrier sealing system prevents the escape of steam from the high-pressure shaft seal are therefore normally implemented. The leakage steam is thus drawn off into a separate system instead of flowing into the atmosphere. This steam may expediently be directed to the low-pressure shaft seal, where it flows out as sealing steam and displaces air from the shaft seal.

The high-pressure leakage quantity and the sealing-steam quantity for the low-pressure shaft seal are ideally in equilibrium; however, systems via which excess leakage steam is drawn off, for example, into the condenser or, conversely, supplemental sealing steam is supplied are normally provided. In this case, the supplemental-sealing-steam feed, in particular in transient operating states, is of importance if the pressure in the high-pressure casings, for example during start-up of the machine, is not yet sufficient in order to deliver a sufficiently large amount of sealing steam. In the event of highly throttled or closed control valves, sealing steam must even be supplied to the high-pressure shaft seals.

The supplemental sealing steam is normally fed from the live-steam line. Thus sealing steam having the high thermodynamic data of the live steam is available at the turbine inlet, and this sealing steam is successively reduced, for example by water injection, to states which are adapted in particular to the material temperature of the shaft and casing of the steam turbine at the respective sealing point.

In transient operation of a turbine, the feeding of live steam into the sealing-steam system, in particular during start-up or an emergency trip, results in inadmissibly large jumps in temperature, which affect the casing and the shaft journals. Such sudden changes in the live-steam data can be corrected by water injection. However, the reduction in the steam temperature by means of water injection is not without its problems especially at high-pressure shaft seals. There is the risk of unevaporated water encountering the hot shaft, a factor which in turn leads to undesirable thermal shocks.

The problems which occur during start-up of a plant can in the meantime be coped with by a sufficiently slow increase in the temperature at the outlet of the superheater of the boiler—that is to say the boiler firing temperature. In particular during the operation of combined-cycle plants, this means that the gas turbines have to be operated at a very low load over a longer period. Apart from the poor efficiency of such an operation, such an operating mode of the plant results in operational difficulties which are not to be underestimated.

At this point, EP 0 605 156 B1 proposes to provide means of feeding the live-steam line from different temperature levels of the boiler. During the start-up of the turbine, the feed of the steam superheated to the maximum extent to the live-steam line is completely or partly interrupted. In this case, the live steam is supplied from an intermediate stage of the superheater at reduced temperature level. Admixing of saturated steam from the boiler drum provides a further means of controlling the live-steam temperature.

Apart from the very high equipment cost, which is necessary to realize the method disclosed by EP 605 156 B1, the thermodynamic state of the steam, which is directed as additional sealing steam to the sealing-steam system, is still linked to the live-steam state. The result of this is that, even when the circuit specified in this publication is implemented, measures for conditioning the sealing steam in certain operating states are necessary. In particular during an emergency trip of a steam turbine, even when the circuit and the method according to EP 0 605 156 B1 are used, there is therefore a high risk of subjecting the shaft and the casing to inadmissibly large jumps in temperature, in particular in the region of the high-pressure shaft seal. This is because, during operation of the machine, the steam from the high-pressure shaft seal expands at least over some labyrinth tips and is therefore already considerably cooler than the live steam. However, during an emergency trip of the turbine, markedly hotter live steam is suddenly fed to the high-pressure shaft seal. As mentioned above, even water injection cannot compensate for this jump in temperature and also leads to the risk of applying water droplets to the surface of the hot shaft.

SUMMARY OF THE INVENTION

The invention intends to provide a remedy here. The aim of the invention, in a circuit for feeding steam into the sealing-steam system of a steam turbine, the steam turbine being supplied with live steam from a boiler via a live-steam line, which boiler comprises at least one evaporator and a superheater, and there being a bleed point at least at one point of the superheater below the live-steam temperature, is to design the circuit in such a way that the sealing-steam temperature is adapted to the material temperatures in the region of the shaft seals.

According to the invention, this is achieved in that the bleed point is selected in such a way that the steam temperature at this bleed point is adapted to the material temperature in the region of a high-pressure shaft seal, in that a feeder line for the sealing-steam system is connected to this bleed point, and in that the feeder line and the sealing-steam system are completely isolated from the live-steam line.

The essence of the invention is therefore to uncouple the supply of the steam turbine with the requisite supplemental sealing steam from the live-steam supply of the machine. To this end, a bleed point, according to the invention, is provided at the superheater of the boiler, and superheated steam below the live-steam temperature is bled at this bleed point, the superheated steam being utilized as supplemental sealing steam.

The advantages of this circuit come into effect, in particular, during an emergency trip of the steam turbine, if the steam turbine has already been in operation for a certain time, and if partly expanded high-pressure steam from the turbine casing has been admitted for quite some time to the components of the machine, for example in the region of the high-pressure shaft seal. During an emergency trip of the turbine, additional sealing steam must be supplied to the shaft seals very quickly. In a circuit which corresponds to the prior art cited, supplemental steam at live-steam temperature is fed to the sealing-steam system, and this supplemental steam is first successively cooled down to a temperature compatible with the material, for example by water injection. This temperature control is of course sluggish, for which reason the shaft and casing in transient operating states are subjected to detrimental jumps in temperature.

According to the invention, the feeder line for the supplemental sealing steam is therefore connected to a bleed point of the superheater, at which bleed point the steam temperature is below the live-steam temperature and is compatible with the material temperature of shaft and casing, in particular in the region of the high-pressure shaft seal. In this case, a bleed point of the superheater at which the steam is present at a temperature of around 400° C. is preferably to be selected.

To control the supplemental-sealing-steam flow into the sealing-steam system, there is advantageously a control valve in the feeder line. This control valve controls the pressure in the sealing-steam system and releases the supplemental sealing steam if the pressure falls below a certain minimum value. In this case, it is also appropriate to provide the feeder line with a drain device, where possible directly upstream of this control valve, or to lay the feeder line in such a way that it drains automatically: since steam does not flow continuously through the feeder line, condensate can form here, the ingress of which into the sealing-steam system would be detrimental.

In a simple case, the feeder line may lead directly from the bleed point of the superheater to the sealing-steam system; however, given an appropriate design of the water/steam cycle, the bleed point of the superheater may also be connected to an auxiliary-steam rail, in which, for example, steam is present at a pressure of 20 bar and a temperature of around 400° C. In addition to the sealing-steam system, further subsystems, such as the evacuating ejectors for example, may then be supplied with steam from this auxiliary-steam rail. Furthermore, an auxiliary-steam rail is of advantage if a plurality of steam sources, such as, for example, the waste-heat boilers of a plurality of gas turbines or an additional auxiliary boiler, are to be connected to the subsystems of the steam turbine.

BRIEF DESCRIPTION OF THE DRAWINGS

The invention is explained in more detail below with reference to the drawing, in which.

DETAILED DESCRIPTION OF THE INVENTION

Figure 1:
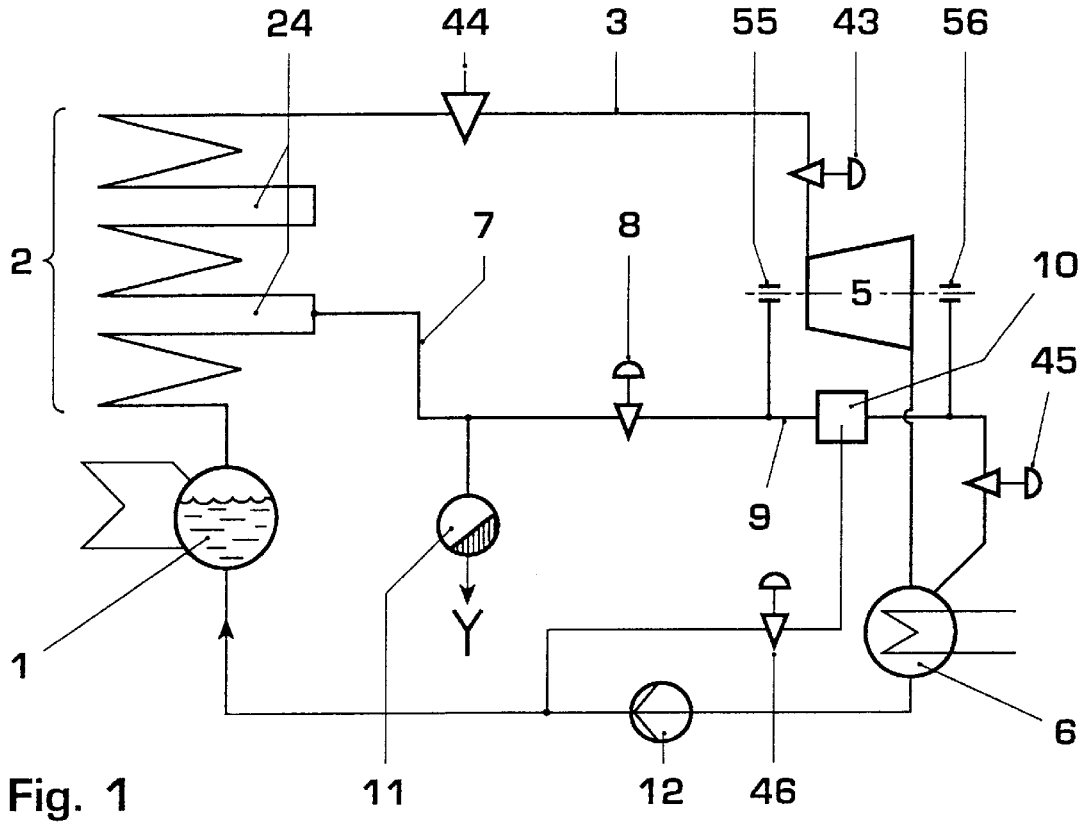
FIG. 1 shows an exemplary embodiment of the invention in which the intermediate bleed point of the superheater is directly connected to the sealing-steam system.

FIG. 1 shows a first embodiment of the invention. Feedwater is put under pressure by a pump 12 and evaporated in an evaporator 1. The saturated steam is superheated to the live-steam state in a superheater 2 and fed via a live-steam line 3, the emergency-trip valve 44 and the turbine control valve 43 to the steam turbine 5 and expanded. The expanded steam is condensed in the condenser 6 and is again available as feedwater.

The pressure in the sealing-steam system 9 is controlled in coordination with the valves 8 and 45. In normal operation of the steam turbine 5, a steam quantity flows out of the high-pressure part of the turbine 5 to the high-pressure shaft seal 55 and from there into the sealing-steam system. This steam quantity is cooled in an injection cooler 10 by the injection of water into the steam and is directed as sealing steam to the low-pressure shaft seal 56, the water injection branching off from the feedwater line, and the injection quantity being set by an injection control valve 46. If the entire steam quantity flowing in at the high-pressure shaft seal 55 cannot be utilized at the low-pressure shaft seal, some of the steam is drawn off via the pressure-relief valve 45, for example into the condenser.

However, a sufficient sealing-steam quantity, that is a minimum pressure in the sealing-steam system 9, must also be ensured when the turbine control valve or the turbine emergency-trip valve is closed or throttled to a very high degree, and thus the pressure at the inlet into the turbine 5 is low, so that no steam can flow from there to the high-pressure shaft seal. Such operating states occur in particular during start-up and during an emergency trip. In this case, the supplemental-sealing-steam control valve 8 opens when the pressure in the sealing-steam system 9 is too low. Via the supplemental-sealing-steam control valve 8 and a feeder line 7, the supplemental-sealing-steam system 9 is connected to the superheater 2 at a suitable bleed point 24, at which there is superheated steam at a temperature which is compatible with the material temperature which is present during steady operation at the high-pressure shaft seal. Here, a feeding-steam temperature of about 400° C. will prove to be suitable in most cases.

Since superheated steam does not flow permanently through the feeder line 7, it is expedient to provide a drain in this line, where possible directly upstream of the supplemental-sealing-steam control valve 8. Otherwise there is the risk of steam condensing out in the feeder line 7 and of this condensate being carried along into the sealing-steam system 9 when the supplemental-sealing-steam control valve is opened. The drain 11 also avoids a situation in which, under certain circumstances, condensate droplets impinge on hot material in the region of the high-pressure shaft seal and cause jumps in temperature.

The mode of operation of the invention is as follows: the directing of the steam in the sealingsteam system during normal operation has already been described. The invention now comes into effect in particular when supplemental sealing steam has to be directed to the high-pressure shaft seal, that is in particular, as mentioned above, during start-up and during an emergency trip of the turbine. According to the prior art, the feeder line 7 is connected to the live-steam line 3 upstream of the emergency-trip valve 44. Especially during an emergency trip, this would mean that live steam flows directly to the high-pressure shaft seal 55, to which partly expanded steam from the high-pressure part of the turbine 5 is admitted during normal operation. This results in a thermal shock to the material of the shaft and the casing in the region of the high-pressure shaft seal 55. In order to avoid local overheating phenomena of the material, water injection may also be present in such a case in the sealing-steam feed line to the high-pressure shaft seal. However, even this water injection can ultimately only regulate the sealing-steam temperature in a rapid manner, and in particular the impingement of water droplets on the hot components has to be avoided. The sealing-steam system is likewise fed with live steam during start-up, as a result of which the shaft and casing at the high-pressure shaft seal 55 are subjected to very large temperature differences. The cumulative effect of these actions results in a potential reduction in the service life on the one hand, but also in unfavorable relative expansions, for which reason operating clearances have to be dimensioned to be larger than necessary and so as to be conducive to a high efficiency.

In an supplemental-sealing-steam feed according to the invention, these disadvantages are avoided by virtue of the fact that the sealing-steam system 9, as already mentioned, is not fed with live steam but with steam from an intermediate bleed 24 of the superheater, the temperature of this steam being lower than the live-steam temperature.

Figure 2:
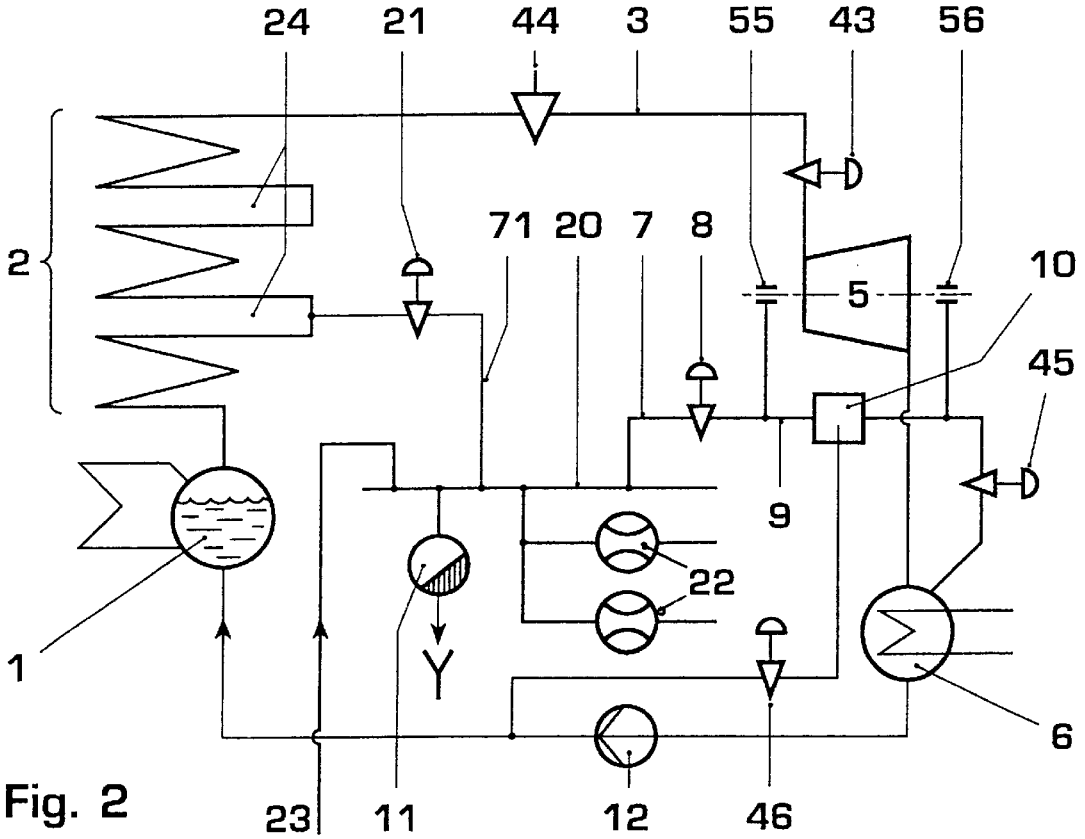
FIG. 2 shows a further preferred embodiment in which an auxiliary-steam rail is connected between the sealing-steam system and the bleed point.

A further embodiment variant of the invention is shown in FIG. 2. The water/steam cycle is identical to that described above. On the other hand, for the feeding of the sealing-steam system, an auxiliary-steam rail 20 is connected between the bleed point 24 of the superheater 2 and the sealing-steam system 9. In the variant shown, a reducing valve 21 is located in the feeder line 71. The pressure of the auxiliary-steam rail is controlled by means of this valve. The variant is suitable in particular when a plurality of steam sources are connected to one or more consumers. In this example, in addition to the sealing-steam system 9, evacuating ejectors 22 are also connected to the auxiliary-steam rail. Furthermore, a further steam source is connected to the auxiliary-steam rail by means of a connecting line 23. This could be a further boiler, or even a small auxiliary boiler as often used in combined-cycle plants in order to provide auxiliary steam for an accelerated start of the plant. The auxiliary-steam rail is also advantageously equipped with a drain 11.

In the example shown, the reducing valve 21 controls the pressure of the auxiliary-steam system. Here, 20 bar, at around 400° C., will often prove to be expedient. As described above, the pressure in the auxiliary-steam system 9 is set by the additional-sealing-steam control valve 8 and the pressure-relief valve 45.

Although this invention has been illustrated and described in accordance with certain preferred embodiments, it is recognized that the scope of this invention is to be determined by the following claims.

What is claimed is:

1. A circuit for feeding supplemental sealing steam into the sealing-steam system of a steam turbine, the circuit comprising:

a steam turbine and a boiler, a steam line for supplying live steam from the boiler to the steam turbine, said boiler comprising at least one evaporator and at least one superheater, the steam turbine having a high pressure shaft seal, the superheater having at least one bleed point below the live-steam temperature, the bleed point being selected such that the steam temperature at said bleed point is compatible with the material temperature in the region of a high-pressure shaft seal, a feeder line for the sealing-steam system is connected to said bleed point, and the feeder line and the sealing-steam system being completely separate from the live-steam line.

2. The circuit as claimed in claim 1, wherein the steam temperature at the bleed point is between 350 and 450° C.

3. The circuit as claimed in claim 1, wherein a control valve for supplemental sealing steam is fitted between the feeder line and the sealing-steam system.

4. The circuit as claimed in claim 1, wherein the feeder line is provided with a drain device.

5. The circuit as claimed in claim 1, wherein the feeder line leads directly from the bleed point to the sealing-steam system.

6. The circuit as claimed in claim 1, wherein the bleed point is connected to an auxiliary-steam rail, which is connected to the sealing-steam system through a feeder line.

7. The circuit as claimed in claim 6, wherein the auxiliary-steam rail is connected to bleed points of a plurality of superheaters.

* * * * *